US012523028B2

(12) United States Patent
Liuzzi et al.

(10) Patent No.: US 12,523,028 B2
(45) Date of Patent: Jan. 13, 2026

(54) FAUCET WITH FLOW CONDITIONER COUPLING

(71) Applicant: ASSA ABLOY Americas Residential Inc., New Haven, CT (US)

(72) Inventors: Vincent Liuzzi, Lake Forest, CA (US); Jan Christopher van Leyen, Mission Viejo, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 126 days.

(21) Appl. No.: 18/527,757

(22) Filed: Dec. 4, 2023

(65) Prior Publication Data

US 2024/0183137 A1 Jun. 6, 2024

Related U.S. Application Data

(60) Provisional application No. 63/430,501, filed on Dec. 6, 2022.

(51) Int. Cl.

| | |
|---|---|
| ***E03C 1/08*** | (2006.01) |
| ***E03C 1/04*** | (2006.01) |
| ***E03C 1/086*** | (2006.01) |

(52) U.S. Cl.
CPC ..... *E03C 1/08* (2013.01); *E03C 1/0404* (2013.01); *E03C 1/086* (2013.01)

(58) Field of Classification Search
CPC ..... E03C 1/08; E03C 1/0404; E03C 1/084; E03C 1/086; E03C 1/0407
USPC ..... 4/678, 675, 676
See application file for complete search history.

(56) References Cited

U.S. PATENT DOCUMENTS

| | | | | |
|---|---|---|---|---|
| 5,758,690 | A * | 6/1998 | Humpert | E03C 1/0404 4/678 |
| 8,104,512 | B2 * | 1/2012 | Nelson | E03C 1/084 4/678 |
| 9,663,929 | B2 * | 5/2017 | Loerch | E03C 1/086 |
| 2024/0035262 | A1 * | 2/2024 | Cipriani | E03C 1/084 |

* cited by examiner

*Primary Examiner* — David J Walczak
(74) *Attorney, Agent, or Firm* — Merchant & Gould P.C.

(57) ABSTRACT

A faucet has a spout body with an outlet end supporting a flow conditioner. An adapter supports the flow conditioner and couples the flow conditioner in fluid communication with a flexible hose. The adapter includes a retainer configured to engage with an inner surface of the spout body to couple and retain the flow conditioner at the outlet end.

18 Claims, 8 Drawing Sheets

FAUCET WITH FLOW CONDITIONER COUPLING

CROSS-REFERENCE TO RELATED APPLICATIONS

This application claims priority to and the benefit of U.S. Provisional Patent Application No. 63/430,501, filed Dec. 6, 2022, the disclosure incorporated by reference herein in its entirety.

BACKGROUND

There are a variety of different types of faucets, including, but not limited to, a widespread faucet (e.g., handles spaced apart from a spout), a centerset faucet (e.g., handles and spout connected by a base), and a single-control faucet (e.g., a single handle and spout). Such faucets typically have multiple characteristic functions and operations, such as, on/off, flow control, and temperature control. Additionally, faucets can be found in many different rooms of a building or structure, including, but not limited to, bathrooms and kitchens.

Typical faucet assemblies include a spout mounted atop a countertop, and one or more handles/operating levers adjacent the spout to control the flow and/or temperature of water flowing from an outlet end of the spout. Flow conditioners are often attached to the outlet end of the spout to condition the flow of water being expelled from the outlet end. For example, an aerator may be used to draw air into the water stream so that the water feels softer and reduces splashing within the sink. In another example, a laminator may be used to generate a consistent water stream so that the water feels softer and reduces splashing within the sink.

Some known spouts have a circular cross-sectional shape, and as such, flow conditioners can be threated into the outlet end. However, other known spouts may have cross-sectional shapes that are different than circular, for example, substantially square or oval cross-sectional shapes. Threads cannot be used with these different shapes, and as such, improvements to how flow conditioners are supported within and coupled to the outlet end of the spout are desired.

SUMMARY

The present disclosure relates generally to faucet spout bodies having a non-circular cross-sectional configuration. A flow conditioner (e.g., aerator or laminator) is supported at an outlet end of the spout body by an adapter. The adapter is configured to engage with an inner surface of the spout body so as to retain and position the flow conditioner at the outlet end.

In an aspect, the technology relates to a faucet including: a spout body having an outlet end with an inner surface; a flexible tube disposed within at least a portion of the spout body; a flow conditioner positioned proximate an end of the flexible tube and at the outlet end of the spout body; and an adapter supporting the flow conditioner, the adapter having a first end and an opposite second end, the second end coupled to the end of the flexible tube such that the flow conditioner is in fluid communication with the end of the flexible tube, the first end having an outer surface supporting at least one retainer directly engaging with the inner surface of the spout body such that the flow conditioner is secured within the outlet end of the spout body.

In an example, the at least one retainer includes an O-ring. In another example, the outer surface of the adapter includes a recessed channel supporting the O-ring. In yet another example, the inner surface of the spout body includes at least one projection interfacing with the at least one retainer. In still another example, the at least one projection includes a ramp surface facing the outlet end and an opposite step surface. In an example, the flow conditioner is substantially rectangular in cross-sectional shape.

In another example, the adapter is substantially rectangular in cross-sectional shape having major sides and minor sides, each of the major sides having one or more lugs that are positioned against the inner surface of the spout body. In yet another example, a first major side has a first lug and a second major side has a second lug, the first lug axially offset from the second lug. In still another example, the minor sides are at least partially rounded.

In another aspect, the technology relates to a faucet including: a spout body having an outlet end with an inner surface; a flow conditioner positioned at the outlet end of the spout body, the flow conditioner having major sides and minor sides, the major sides longer than the minor sides; an adapter having a first end and an opposite second end, the adapter having an opening extending therethrough, the first end shaped and sized to support the flow conditioner such that the adapter has corresponding major walls and minor walls, the first end having at least one retainer exterior of the flow conditioner, the at least one retainer slidable within the inner surface of the spout body to secure the first end of the adapter at the outlet end of the spout body; and a flexible tube coupled to the second end of the adapter, the flexible tube in fluid communication with the flow conditioner.

In an example, the adapter is visible at the outlet end of the spout body. In another example, the inner surface of the spout body defines a stop that engages with the at least one retainer. In yet another example, the first end of the adapter includes a flange that prevents the first end of the adapter from sliding past the stop when being inserted into the outlet end of the spout body. In still another example, the at least one retainer is formed from a resilient material. In an example, the at least one retainer is located one the major walls and the minor walls of the adapter.

In another example, the spout body is at least partially curved in shape, a radius of curvature of the spout body being less than three inches. In yet another example, a first major wall of the adapter includes at least one first lug and a second major wall of the adapter includes at least one second lug, the at least one first and second lugs engaging with the inner surface of the spout body to position the adapter therein. In still another example, the first end of the adapter has a different cross-sectional shape than the second end of the adapter.

In another aspect, the technology relates to a faucet including: a spout body having an outlet end with an inner surface, the inner surface including at least one projection proximate the outlet end; a flexible tube disposed at least partially within the spout body, the flexible tube slidable with respect to the spout body; an adapter coupled to an end of the flexible tube proximate the outlet end of the spout body, the adapter having an inner cavity and an outer surface, an O-ring is supported on the outer surface, and at least two lugs extend from the outer surface; and a flow conditioner supported at least partially within the inner cavity of the adapter and in fluid communication with the flexible tube, wherein the at least two lugs are disposed on opposite sides of the adapter and offset along a length of the adapter, wherein upon insertion of the adapter into the outlet end, the O-ring at least partially compresses to slide across the at least one projection such that the O-ring engages with the inner surface and secures the flow conditioner at the outlet end of the spout body, the at least two lugs are positioned against the inner surface of the spout body.

In an example, the flow conditioner is spaced apart from the end of the flexible tube.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular examples of the present disclosure and therefore do not limit the scope of the present disclosure. The drawings are not to scale and are intended for use in conjunction with the explanations in the following detailed description. Examples of the present disclosure will hereinafter be described in conjunction with the appended drawings, wherein like numerals denote like elements.

DETAILED DESCRIPTION

Figure 1:
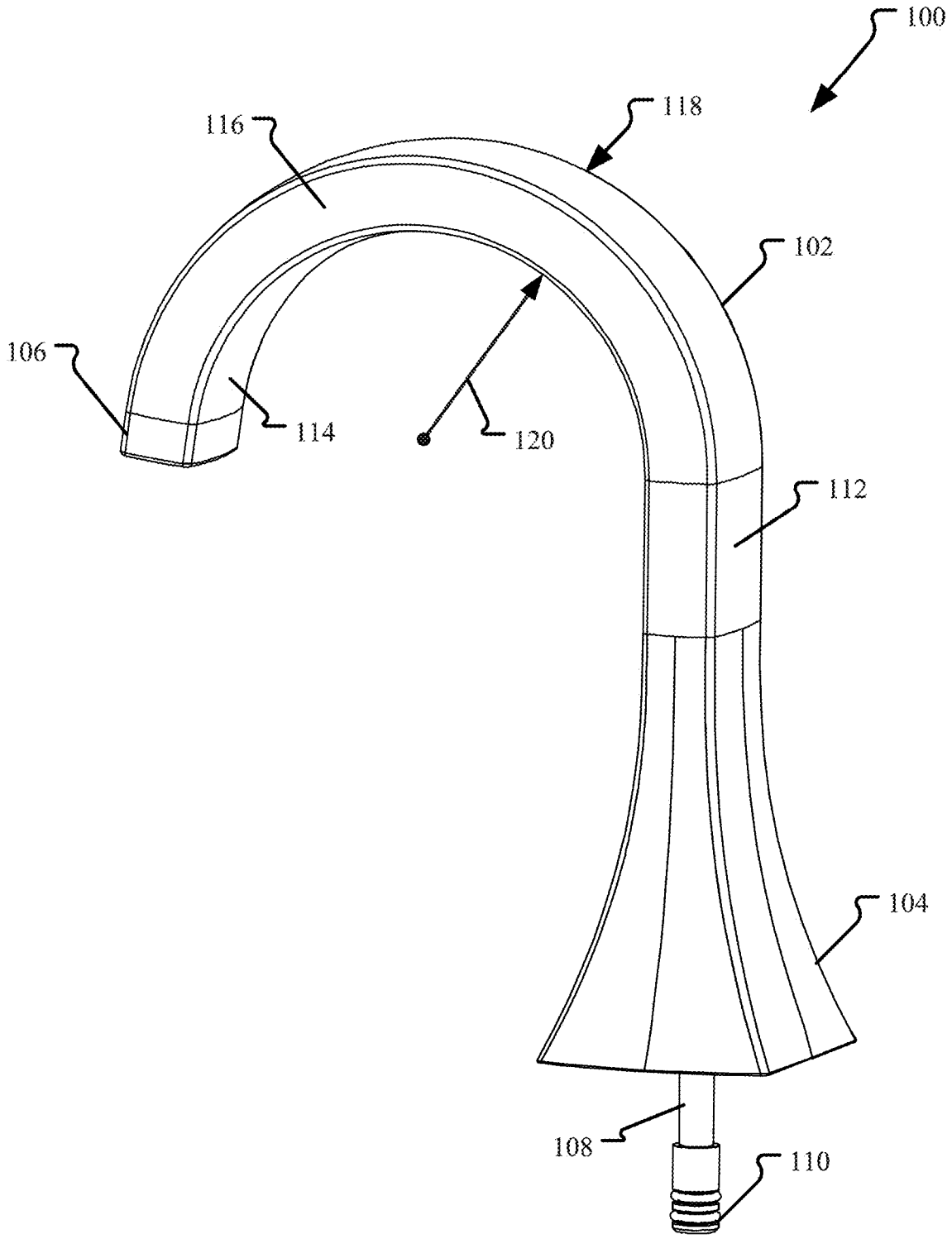
FIG. 1 is a perspective view of an exemplary faucet and in accordance with the principles of the present disclosure.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible embodiments for the appended claims.

Faucets generally include a flow conditioner (e.g., an aerator or a laminator) for dispensing a flow of water from a spout body. Typically the flow conditioner is threaded within an outlet end of the spout body for positioning and securement therein. This connection configuration works well for a spout body and a flow conditioner that have substantially circular cross-sectional shapes, however, not all spout bodies and/or flow conditioners have such a shape. For example, a spout body and/or flow conditioner may have a substantially rectangular or oval cross-sectional shape. Given this type of shape, the flow conditioner cannot merely be threaded into the outlet end.

Some known non-circular faucets can have an exterior hole with a set screw to directly engage with the flow conditioner and retain it therein. Such exterior holes are typically, for aesthetic purposes, located on a rearward-facing portion of a faucet spout body. However, machining the exterior hole requires specialized tools that increases manufacturing costs. Also, these specialized tools can at least partially determine the shape of the faucet as surfaces that the holes are provided in have to be spaced apart from other portions of the spout body in order to fit the specialized tools in the space formed between an upward-oriented portion of the faucet spout body and a downward-oriented end portion of the faucet spout body. Furthermore, the set screw needs to carefully positioned so as to not puncture the flow conditioner. As such and in the examples described herein, an adapter is provided to facilitate coupling the flow conditioner to the outlet end of the spout body and coupling the flow conditioner to a flexible tube within the spout body.

In examples, the adapter supports the flow conditioner at least partially therein, and includes at least one retainer on its outer surface to engage with an inner surface of the spout body. Therefore, the adapter can be inserted into the outlet end of the spout body so as to secure and position the flow conditioner within the outlet end. The inner surface of the spout body may include one or more projections that are configured to engage with the retainer of the adapter to facilitate securement of the adapter therein. The adapter also includes a collar for attachment to the flexible hose and coupling the flow conditioner in fluid communication with the flexible hose. In an example, the flexible hose is spaced apart from the flow conditioner at the adapter. Additionally, the adapter may include exterior positioning lugs that are configured to help orientating and positioning of the adapter within the outer end of the spout body. The lugs are discrete from the retainer of the adapter.

FIG. 1 is a perspective view of an exemplary faucet 100. The faucet 100 includes a spout body 102 having a base 104 and an outlet end 106. The spout body 102 is hollow and includes a flexible tube 108 disposed at least partially therein. One end of the of the flexible tube 108 includes a fitting 110 that enables the flexible tube 108 to be connected to a water source (not shown). In the example, the faucet 100 is a tube-in-spout configuration whereby the flexible tube 108 is configured to channel a flow of water from the water source and so that the outlet end 106 of the spout body 102 can selectively dispense water. One or more handles (not shown) may be coupled in operational control with the water source so that flow rate (including on/off functionality) and temperature of the water can be controlled through the flexible tube 108. The faucet 100 may be part of a widespread faucet assembly (e.g., the handles spaced apart from the spout body 102 and the base 104 mounted on a countertop). In another example, the faucet 100 may be part of a centerset faucet assembly (e.g., the handles and the base 104 of the spout body 102 mounted on a plate (not shown) for mounting on a countertop). It should be appreciated that the spout body 102 may be part of any other faucet configuration known to those skilled in the art.

The spout body 102 generally has a substantially rectangular cross-sectional shape with an outer major wall 112 and an opposite inner major wall 114. A first minor wall 116 and a second minor wall 118 extend between the major walls 112, 114 on opposite sides. The major walls 112, 114 are longer than the minor walls 116, 118. The outlet end 106 is oriented in a substantially vertical direction so as to allow water to be dispensed therefrom. The base 104 is also oriented in a substantially vertical direction so as to allow the faucet 100 to be mounted on an underlying surface (not shown). A top end of the spout body 102 has a generally curved shape so as to enable the transition between the outlet end 106 and the base 104. In the example, a radius of curvature 120 of the inner major wall 114 may be less than or equal to three inches. In another example, the radius of curvature 120 of the inner major wall 114 may be between two and three inches. In yet another example, the radius of curvature 120 of the inner major wall may be about 2¾ inches.

The base 104 has an enlarged base end with the same or similar rectangular cross-sectional shape that tapers inwardly as the spout body 102 increases in height. As such, the bottom end of the base 104 has a cross-sectional area that is larger than a cross-sectional area of the spout body 102 above the base 104. In the example, all of the major walls 112, 114 and the minor walls 116, 118 taper inwardly at the base 104.

The flexible tube 108 may be formed from a plastic material. For example, the flexible tube 108 may be formed from a polyethylene resin configured for operation at elevated or raised temperatures (e.g., PE-RT tubing). The spout body 102 may be from zinc or a zinc based material. This is in contrast to a wetted spout (e.g., a spout lacking a separate interior tube or liner, in which the spout body itself forms a waterway) that is typically formed from brass.

Figure 2:
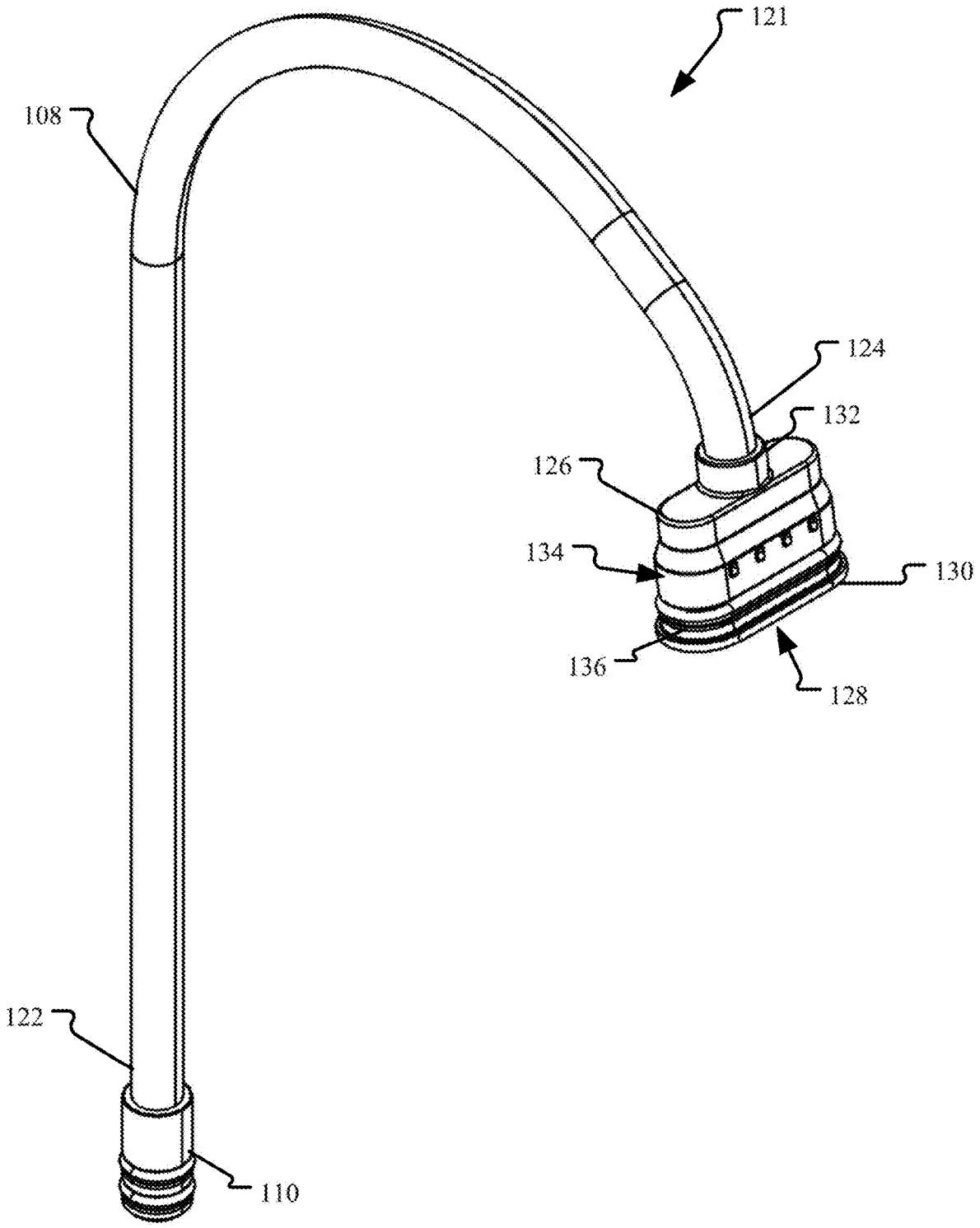
FIG. 2 is a perspective view of a hose assembly of the faucet shown in FIG. 1.

FIG. 2 is a perspective view of a hose assembly 121 of the faucet 100 (shown in FIG. 1). The flexible tube 108 is received within the spout body 102 (shown in FIG. 1) and substantially conforms to the shape thereof. In the example, the flexible tube 108 is configured to allow water to flow therethrough, and as such, the spout body 102 does not have water directly flow therein. A first end 122 of the flexible tube 108 includes the fitting 110. A second end 124 of the flexible tube 108 is coupled to an adapter 126. The adapter 126 is configured to be inserted into the outlet end 106 (shown in FIG. 1) of the spout body 102 and couple within the spout body 102. As such, the flexible tube 108 may be slidable within the spout body 102. The adapter 126 supports a flow conditioner 128 and enables the flow conditioner 128 to be in fluid communication with the flexible tube 108 such that water dispenses from the flow conditioner 128.

The adapter 126 has a first end 130 and an opposite second end 132. The first end 130 is configured to support the flow conditioner 128 therein and allows for water to be dispensed from the flow conditioner 128. The second end 132 couples to the flexible tube 108. An outer surface 134 of the adapter 126 supports at least one retainer 136 proximate the first end 130. The retainer 136 is configured to couple the adapter 126 within the outlet end 106 of the spout body 102. The retainer 136 is described further below. The second end 132 is configured to couple to the flexible tube 108.

Figure 3:
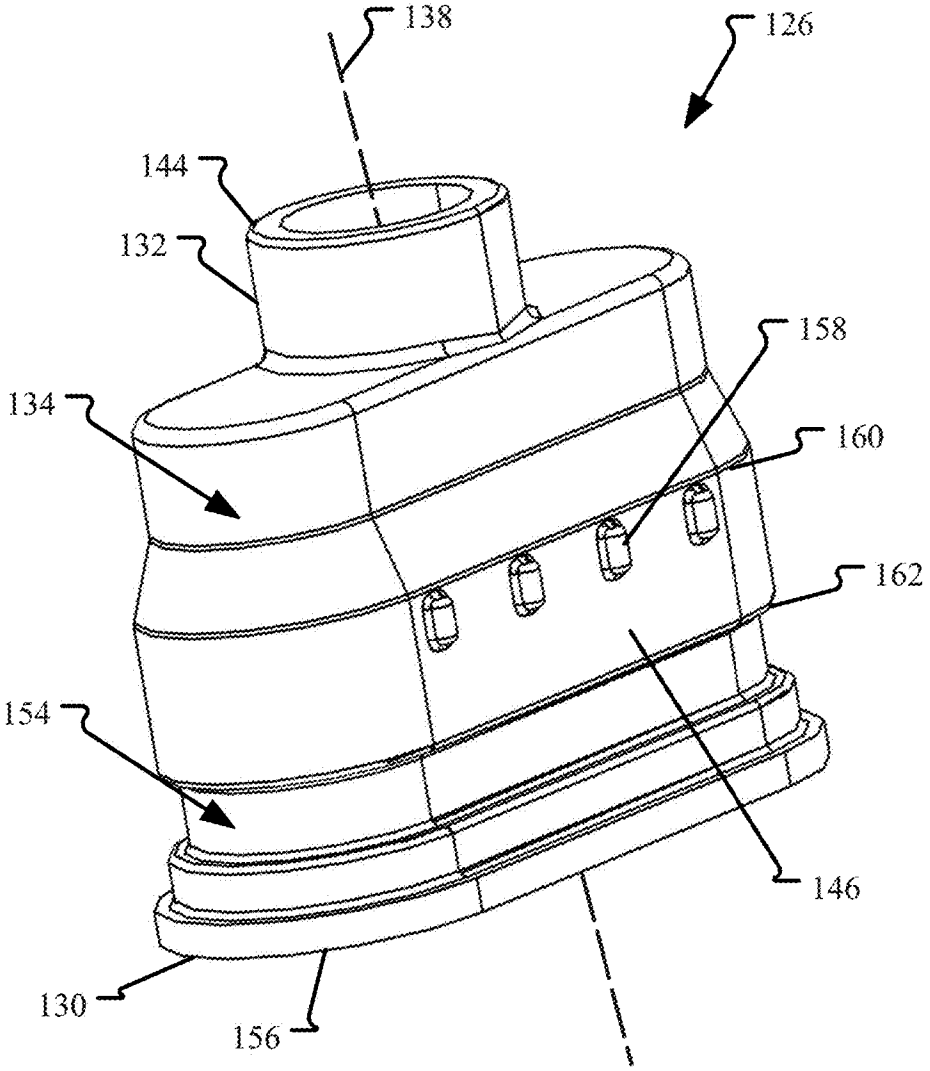
FIG. 3 is a perspective view of an adapter of the hose assembly shown in FIG. 2.
Figure 4:
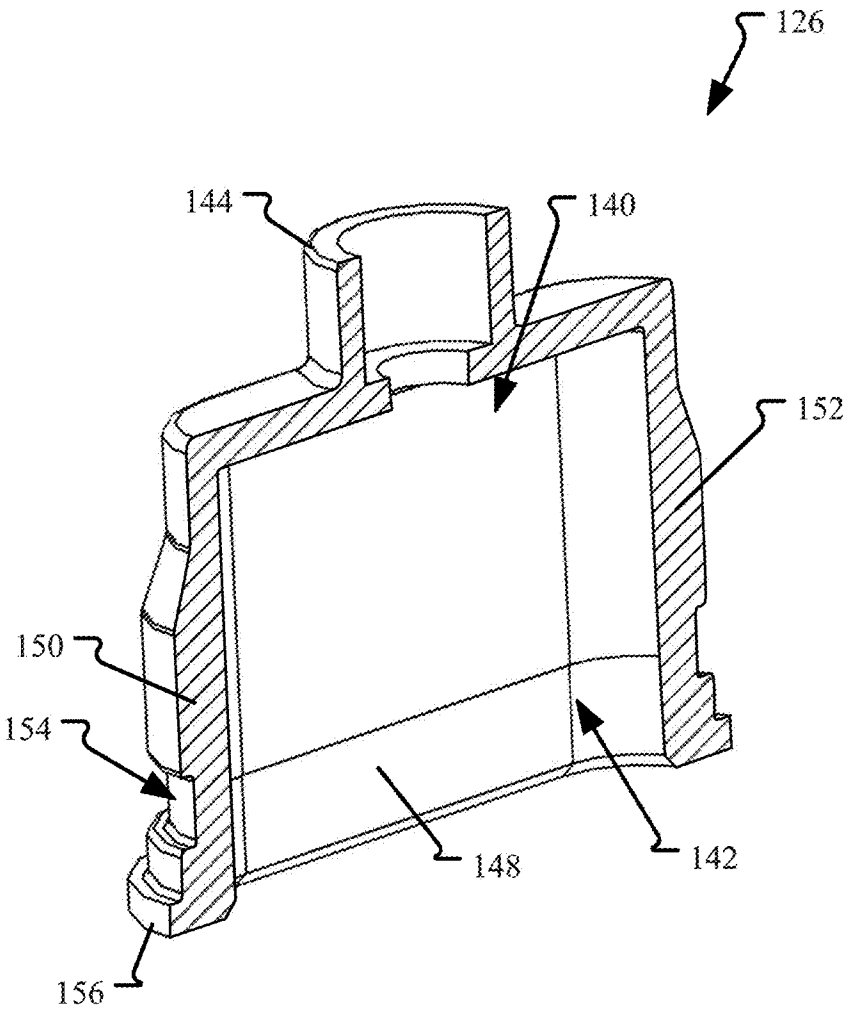
FIG. 4 is a cross-sectional, perspective view of the adapter shown in FIG. 3.

FIG. 3 is a perspective view of the adapter 126. FIG. 4 is a cross-sectional, perspective view of the adapter 126. Referring concurrently to FIGS. 3 and 4, the first end 130 and the second end 132 define a longitudinal axis 138. A through-opening 140 is defined within the adapter 126 and extends between the first end 130 and the second end 132 along the longitudinal axis 138. The opening 140 at the first end 130 defines an interior cavity 142 that is shaped and sized to receive the flow conditioner 128 (shown in FIG. 5). The second end 132 includes a collar 144 which is sized and shaped to receive the end of the flexible tube 108 (shown in FIG. 2). In an aspect, the collar 144 is an over-molded component so as to secure the flexible tube 108 therein. The collar 144 is in flow communication with the interior cavity 142 such that water can flow through the adapter 126. In an aspect, the coupling between the flexible tube 108 and the collar 144 is a fixed connection and does not allow the adapter 126 to rotate relative to the flexible tube 108.

The first end 130 of the adapter 126 is substantially rectangular cross-sectional shape with a first major wall 146 and an opposite second major wall 148. A first minor wall 150 and a second minor wall 152 extend between the first and second major walls 146, 148 and on opposite sides. In the example, the minor walls 150, 152 are curved and the major walls 146, 148 are longer than the minor walls 150, 152. The first end 130 of the adapter 126 has a different cross-sectional shape (e.g., substantially rectangular, such as being rectangular or oval in shape) than the second end 132. For example, the collar 144 is cylindrical in shape.

The outer surface 134 of the adapter 126 has a recessed channel 154 shaped and sized to at least partially receive the retainer 136 (shown in FIG. 2). In the example, the recessed channel 154 extends completely around the longitudinal axis 138 and is formed in each of the major walls 146, 148 and minor walls 150, 152. The first end 130 of the adapter 126 also includes a flange 156 that projects outward. The flange 156 also extends completely around the longitudinal axis 138 and is formed in each of the major walls 146, 148 and minor walls 150, 152.

The adapter 126 also includes a plurality of lugs 158 that extend outward from the outer surface 134. The lugs 158 are disposed on both of the major walls 146, 148 and are spaced apart from one another. In an aspect, the lugs 158 are elongated along the longitudinal axis 138. In the example, the lugs 158 on the first major wall 146 are positioned closer to the second end 132 and adjacent transition line 160 where the shape of the adapter 126 changes. In contrast, the lugs 158 on the second major wall 148 (not visible in FIGS. 3 and 4) are positioned closer to the first end 130 and adjacent transition line 162 where the shape of the adapter 126 changes. As such, the lugs 158 on the first major wall 146 are axially offset from the lugs 158 on the second major wall 148 relative to the longitudinal axis 138.

In the example, the adapter 126 may be formed from a plastic based material, such as, but not limited to, acrylonitrile butadiene styrene (ABS).

Figure 5:
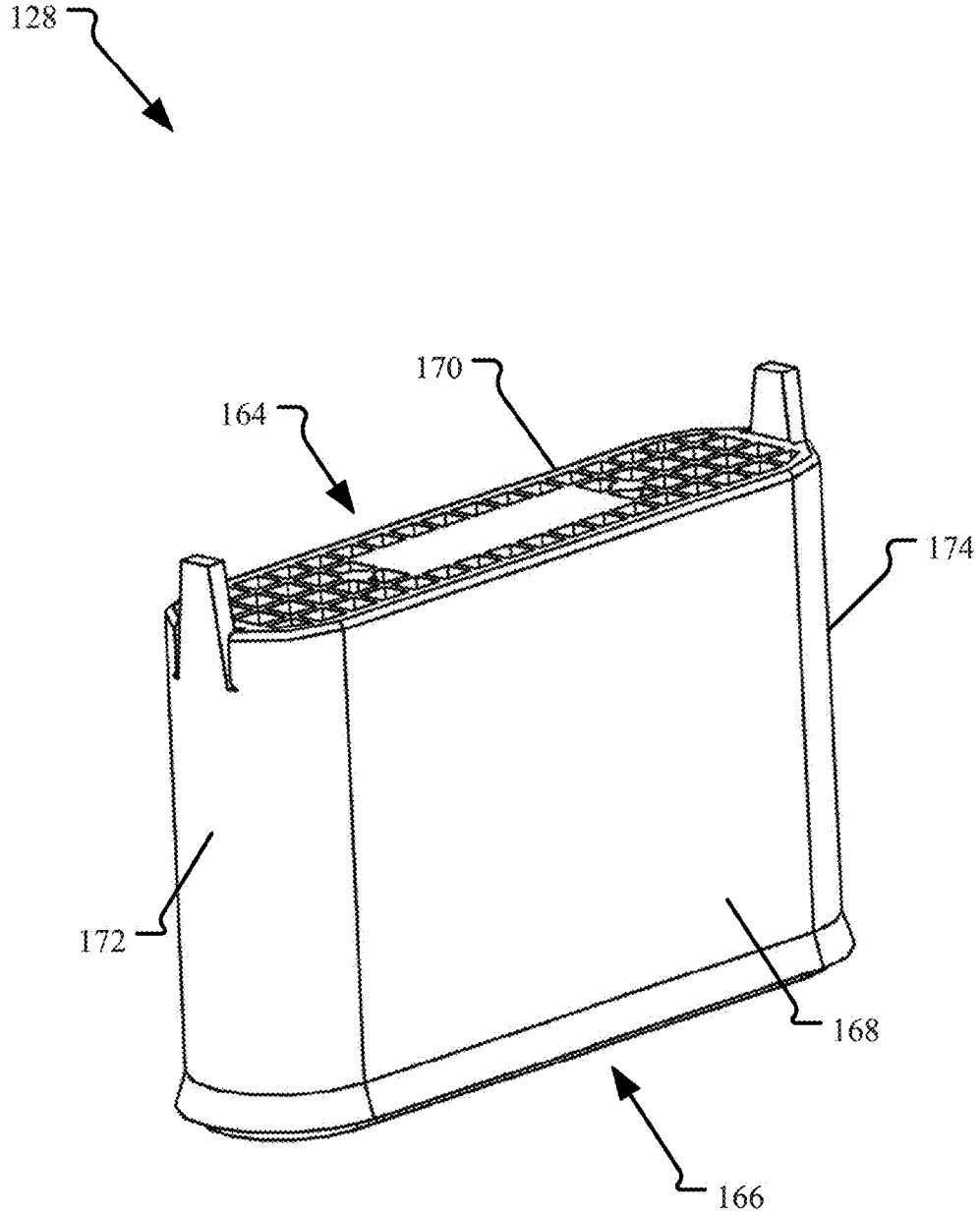
FIG. 5 is a perspective view of a flow conditioner of the hose assembly shown in FIG. 2.

FIG. 5 is a perspective view of the flow conditioner 128. The flow conditioner 128 is configured to be press-fit within the interior cavity 142 of the adapter 126 (shown in FIGS. 3 and 4). In other examples, the flow conditioner 128 may be coupled to the adapter 126 with any other connection type that enables the flow conditioner 128 and the adapter 126 to function as described herein (e.g., snap-fit, latched, etc.). The flow conditioner 128 has an inlet 164 and an opposite outlet 166. The inlet 164 is configured to face the flexible tube 108 (shown in FIG. 2) and receive a flow of water, while the outlet 166 is configured to dispense water from the faucet 100 (shown in FIG. 1).

The flow conditioner 128 has a substantially rectangular cross-sectional shape with a first major side 168 and an opposite second major side 170. A first minor side 172 and a second minor side 174 extend between the first and second major sides 168, 170. In the example, the minor sides 172, 174 are curved and the major sides 168, 170 are longer than the minor sides 172, 174. In the example, the outlet end 106 of the spout body 102 (shown in FIG. 1), the adapter 126, and the flow conditioner 128 all have corresponding rectangular shapes. Because the inlet 164 of the flow conditioner 128 is substantially rectangular in shape and different in shape than the flexible tube 108, it is more difficult to couple the flow conditioner 128 in fluid communication with the flexible tube 108. Additionally, the outlet 166 of the flow conditioner 128 is substantially rectangular in shape and cannot be threaded into the outlet end 106 of the spout body 102. As such, the adapter 126 is utilized to both couple the flow conditioner 128 to the flexible tube 108 and support the flow conditioner 128 within the outlet end 106 of the spout body 102.

The flow conditioner 128 is configured to make the water feel softer when flowing out of the faucet 100 and/or to reduce splashing to ensure that water stays within the sink. The flow conditioner 128 may be an aerator that introduces air into the water stream. In other examples, the flow conditioner 128 may be a laminator that generates a laminar flow of the water stream. Other types of flow conditioners are also contemplated herein.

Figure 6:
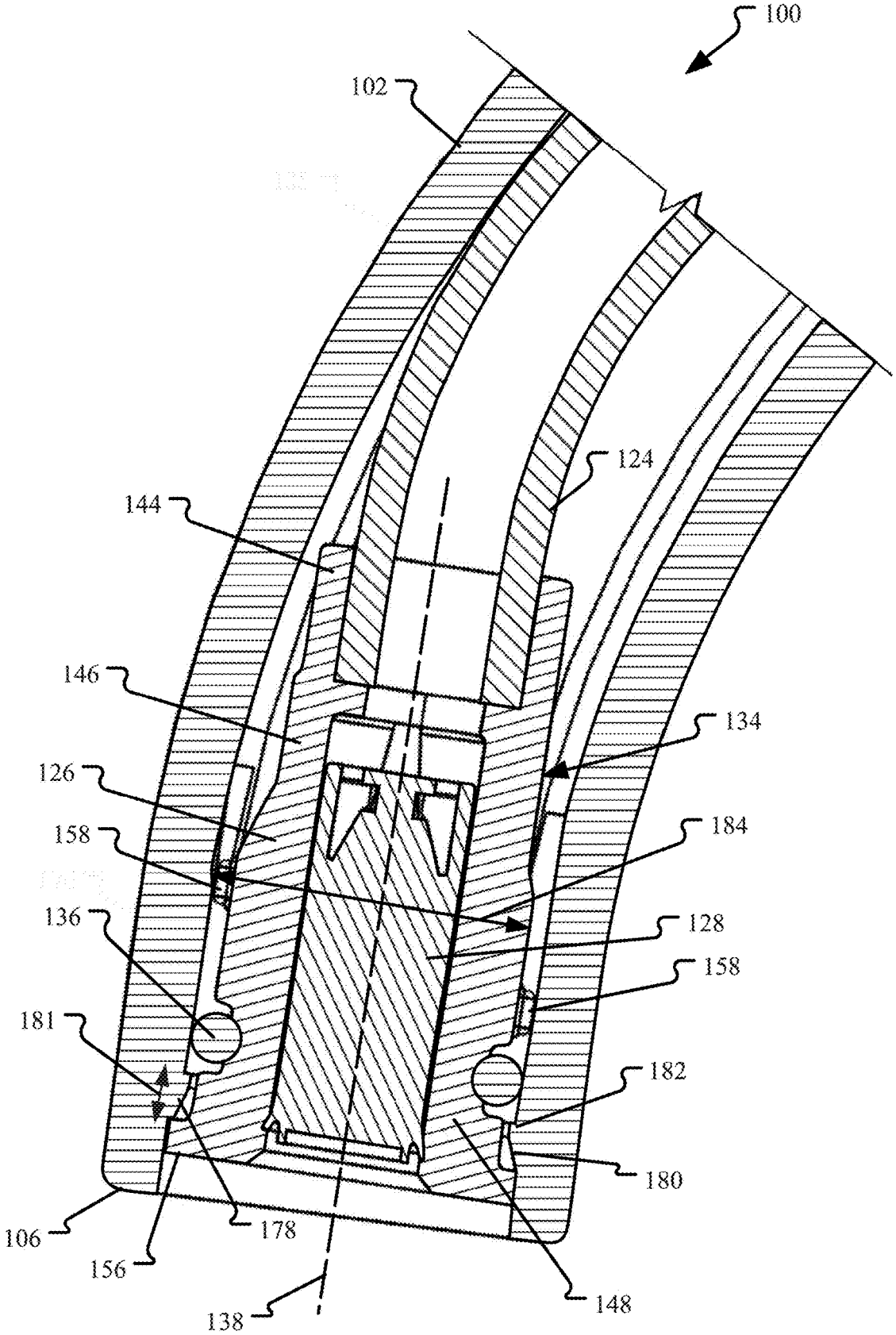
FIG. 6 is a cross-sectional view of an outlet end of the faucet shown in FIG. 1.
Figure 7:
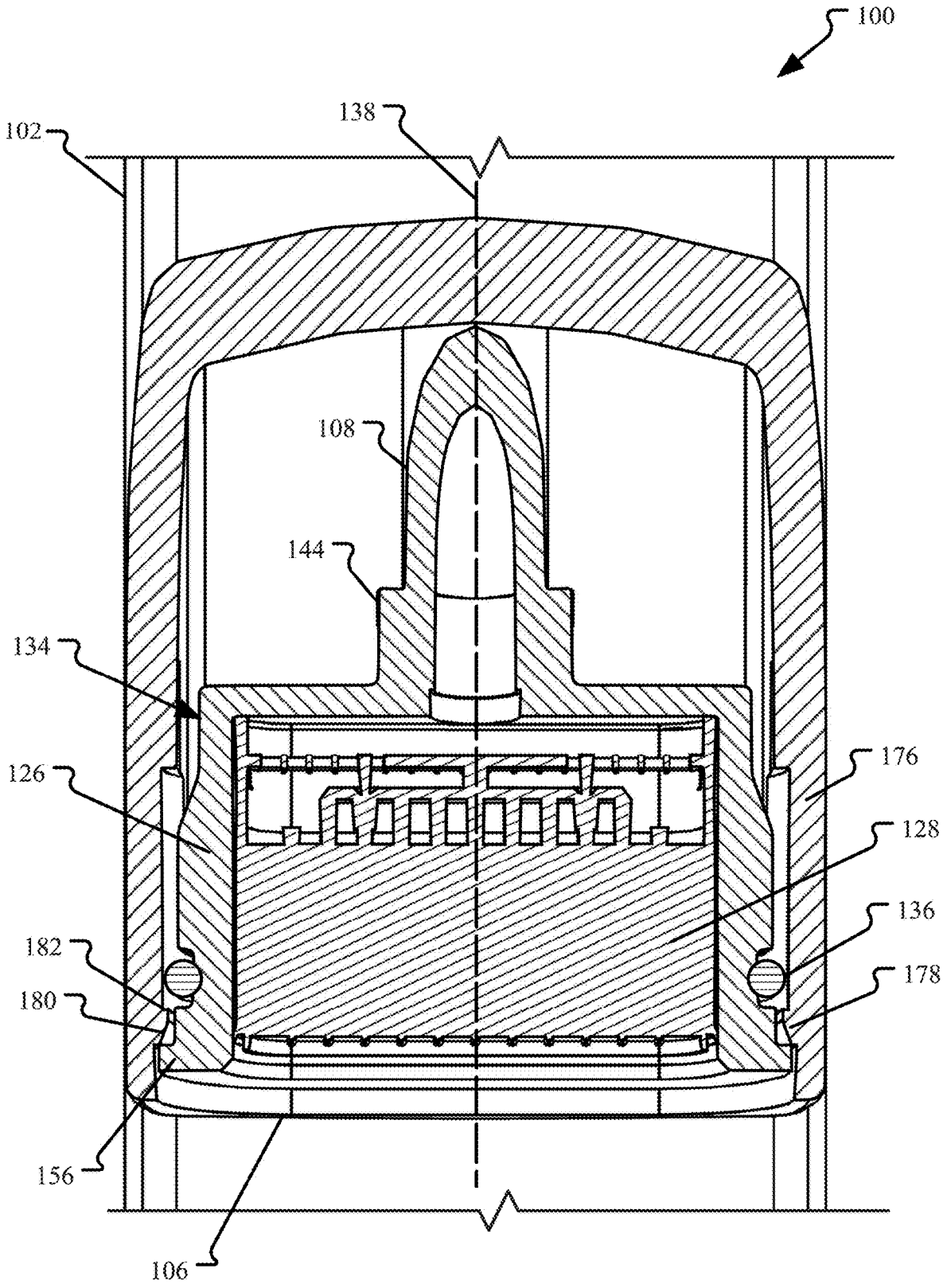
FIG. 7 is another cross-sectional view of the outlet end of the faucet shown in FIG. 1.

FIG. 6 is a cross-sectional view of the outlet end 106 of the faucet 100 taken along a minor wall direction. FIG. 7 is another cross-sectional view of the outlet end 106 taken along a major wall direction. Referring concurrently to FIGS. 6 and 7, the adapter 126 enables the flow conditioner 128 to be positioned proximate the flexible tube 108 and at the outlet end 106 of the spout body 102. In the example, the adapter 126 directly engages with the spout body 102 to secure the adapter 126, and thereby the flow conditioner 128, at the outlet end 106.

The spout body 102 is hollow and defines an inner surface 176. Generally, the inner surface 176 of the spout body 102 is substantially smooth so as to allow the flexible tube 108 to slide therein during assembly and installation. The retainer 136 of the adapter 126 is configured to directly engage with the inner surface 176 so as to secure the adapter 126 within the outlet end 106 and position the flow conditioner 128 at the outlet end 106. During assembly and/or installation of the faucet 100, the second end 124 of the flexible tube 108 may be extended outward from the outlet end 106 such that the adapter 126 with the flow conditioner 128 therein is positioned out of the spout body 102. The collar 144 is then inserted into the outlet end 106 such that the outer surface 134 of the adapter 126 faces and slides along the inner surface 176 of the spout body 102. The retainer 136 then slides against and frictionally engages with the spout body 102 so as to retain the adapter 126. In the example, the inner surface 176 proximate the outlet end 106 is machined in order to provide a more smooth surface consistent along both the major and minor walls and ensure that the adapter 126 fits well within the outlet end 106.

In the example, the retainer 136 is an O-ring that secures the adapter 126 within the outlet end 106. The O-ring may be formed from a resilient material (e.g., rubber and/or elastomer based) and the O-ring extends completely around the adapter 126 (e.g., being located on both the major walls and minor walls). The O-ring is a "male" style O-ring that projects from the recessed channel within the outer surface 134 of the adapter 126. In other examples, the retainer 136 may not extend completely around the adapter 126 (e.g., being located on one or more of the major and/or minor walls). In an aspect, the O-ring is not configured to provide a water seal as the water flows within the adapter 126 and the retainer 136 is exterior of the flow conditioner 128. In other examples, the retainer 136 may be configured to be snap-fit or press-fit within the outlet end 106. In other aspects, the retainer 136 may be configured as fins, tabs, or other extension like members of the adapter 126 that engage with the spout body 102 as described herein and which form a press-fit connection. In an example, the retainer 136 is not a threaded feature.

The inner surface 176 of the spout body 102 may include at least one projection 178 proximate the outlet end 106. The projection 178 is configured to interface with the retainer 136 so as to restrict or prevent the adapter 126 from sliding or being pulled back out of the outlet end 106. The projection 178 extends completely around the spout body 102 (e.g., being located on both the major walls and minor walls). In other examples, the projection 178 may not extend completely around the spout body 102 (e.g., being located on one or more of the major and/or minor walls). In the example, the projection 178 has a ramp surface 180 that faces the outlet end 106 and an opposite step surface or stop 182. The ramp surface 180 is tapered and facilitates the retainer 136 being inserted into the outlet end 106, while the stop 182 restricts the retainer 136 from moving back past the projection 178. In an aspect, the stop 182 is a 90° shoulder. In another aspect, the projection 178 is not a threaded feature. The flange 156 of the adapter 126 is sized such that it prevents the adapter 126 from completely sliding past the projection 178. Rather, only the retainer 136 is configured to slide past the projection 178. In an aspect, the projection 178 is machine formed within the outlet end 106 of the spout body 102 and with the same process that the inner surface 176 is formed.

The first end 130 of the adapter 126 having the flange 156 and the retainer 136 is engaged with the outlet end 106 once inserted within the spout body 102. The second end 132 of the adapter 126, however, may have more space between the outer surface 134 and the inner surface 176. To maintain the position and orientation of the adapter 126, and thereby the flow conditioner 128, so that the outlet end 106, the adapter 126, and the flow conditioner 128 are centered with respect to each other and co-axially align with the longitudinal axis 138, the lugs 158 are also configured to be positioned against the inner surface 176 of the spout body 102. The lugs 158 are sized so that if the lugs 158 have the same axial alignment along the longitudinal axis 138, the lugs 158 would not slide past the projection 178. As such, the lugs 158 on one major wall are axially offset from the lugs 158 on the other major wall, for example by at least a distance corresponding to a length 181 of the ramp surface 180 and the stop 182, ensuring that lugs 158 on opposing sides clear past the stop 182 before opposing lugs reach the ramp surface 180. This configuration enables for the adapter 126 to be slid or angled during insertion into the outlet end 106 and so as to move the lugs 158 past the projection 178. In the example, the lugs 158 are substantially rigid, unlike the retainer 136.

In operation, the collar 144 of the adapter 126 is inserted into the outlet end 106 first. The adapter 126 is then slid or angled while being inserted between at least two different orientations or positions so as to allow the lugs 158 to move past the projection 178. For example, to clear the lugs 158 on the first major wall 146, the second major wall 148 is moved closer to the projection 178, and then to clear the lugs 158 on the second major wall 148, the first major wall 146 is moved closer to the projection 178. In the example, a depth 184 between the lug 158 on one major wall and the outer surface 134 of the opposite major wall is sized so as to clear the projection 178.

The retainer 136 compresses or deflects at least partially to slide across the projection 178 to then release and engage with the inner surface 176 and secure the adapter 126 within the outlet end 106. The flange 156 of the adapter 126 prevents over insertion of the adapter 126 within the outlet end 106. In an aspect, the connection between the spout body 102 and the adapter 126 is completely within the spout body 102 and no connection components are visible on the major or minor walls. Additionally, the major and minor walls do not include any holes or openings to facilitate the aesthetic configuration of the faucet 100. Further, the adapter 126 and the flow conditioner 128 are recessed within the outlet end 106. In an aspect, once the adapter 126 is coupled within the outlet end 106, the retainer 136 and the projection 178 are not configured to allow the flow conditioner 128 to be easily removed from the spout body 102, and for example, be pushed back out of the outlet end 106. As such, the configuration of the adapter 126 described herein would not work for pull-down or pull-out types of faucets.

The adapter 126 is configured to space the flow conditioner 128 apart from the flexible tube 108 along the longitudinal axis 138. The longitudinal length of the adapter 126 is such that the adapter 126 can fit within the outlet end 106. The over molded configuration of the collar 144 has the end portion of the flexible tube 108 coaxial with the longitudinal axis 138, and thus, the flexible tube 108 has a curvature that is different than the spout body 102 and as shown in FIG. 6. In other examples, the collar 144 may be at least partially angled (e.g., 5°) relative to the longitudinal axis 138 so as to facilitate a smoother curvature of the flexible tube 108 and facilitate a tighter curvature of the spout body 102. In this example, the flexible tube 108 may be ultrasonically or laser welded to the collar 144 and the longitudinal length of the collar 144 can be decreased.

Figure 8:
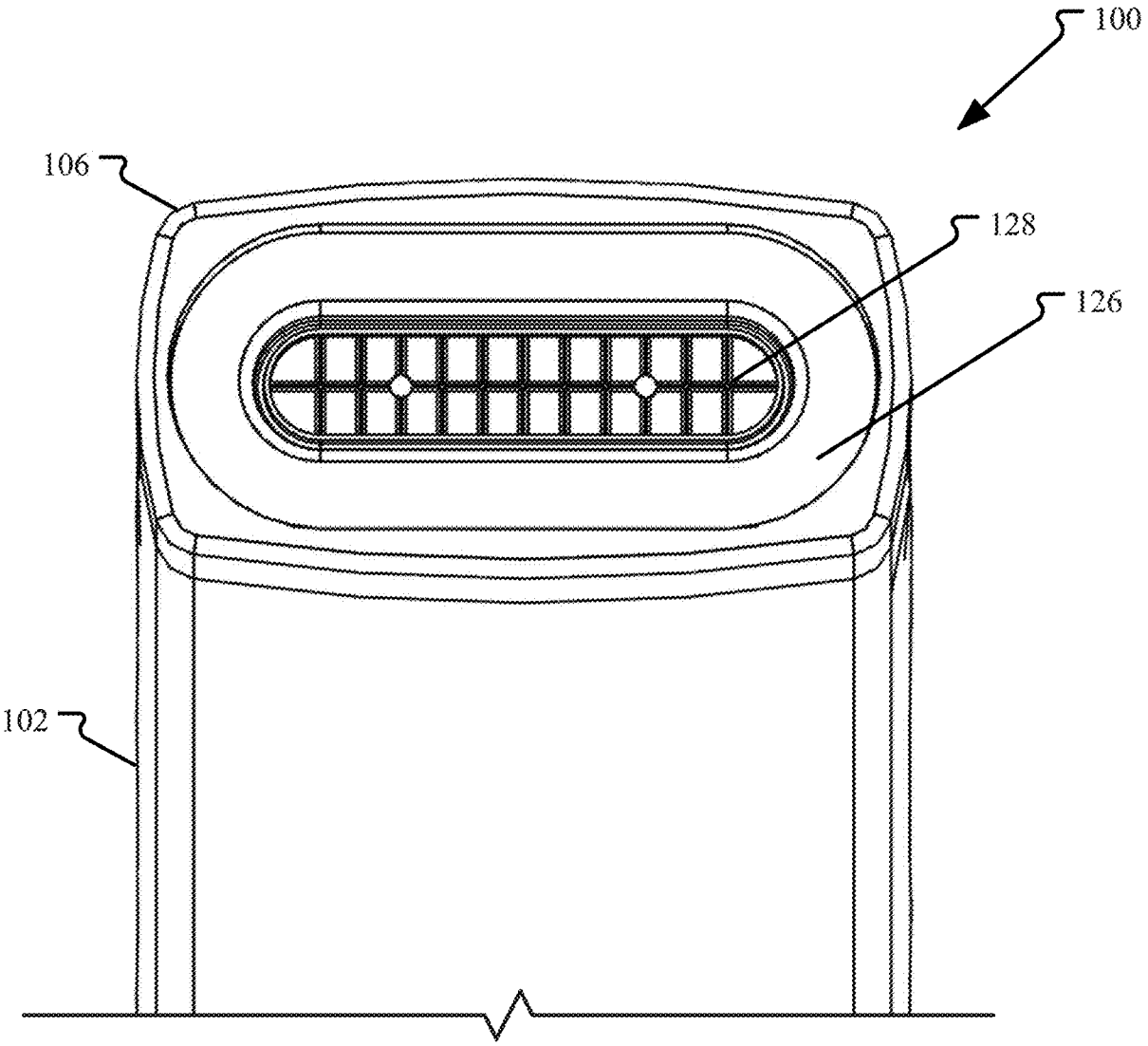
FIG. 8 is a partial bottom view of the outlet end of the faucet shown in FIG. 1.

FIG. 8 is a partial bottom view of the outlet end 106 of the faucet 100. When viewed from the bottom, the adapter 126 and the flow conditioner 128 is visible within the outlet end 106 of the spout body 102. The outlet of the flow conditioner 128 has a substantially rectangular shape. In the example, the substantially rectangular shape includes a rectangle having semi-circles at each minor end. In other examples, the substantially rectangular shape may include a rectangle with square or rounded corners. It is appreciated that other non-circular shapes are also contemplated herein, and for example, oval shapes. The end of the adapter 126 surrounds the flow conditioner 128 is and is substantially concentric therewith. The outlet end 106 of the spout body 102 has an opening that corresponds to the outer surface of the adapter 126 and is also substantially concentric. As shown in FIG. 8, none of the major or minor walls of the spout body 102 have holes or openings that facilitate the coupling of the flow conditioner 128. Rather, the adapter 126 couples to the outlet end 106 fully and completely within the spout body 102. For example, the retainer of the adapter 126 is not a set screw that is externally assessable from the spout body 102.

The adapter described herein facilities use of spout tubes and/or flow conditioners having non-circular cross-sectional shapes in faucets. The adapter is configured to be inserted into the outlet end of the spout tube and engage with an inner surface of the spout tube. By having a fully internal coupling, the exterior aesthetic of the spout tube is allowed to be maintained without having visible connection components. The retainer disposed on the adapter is configured to slide past a corresponding stop within the spout tube during insertion and retained therein, without being easily disassembled. Additionally, because the retainer is on one end of the adapter, the adapter can also include one or more positioning lugs on the opposite end. The lugs also may engage with the inner surface of the spout tube in order to facilitate centering and orientation of the flow conditioner within the outlet end. In an aspects, the lugs may be offset from each other so as to allow for insertion of the adapter within the outlet end and to provide clearance with respect to the internal stop.

References in the specification to "one example," "an example," "an illustrative example," etc., indicate that the example described may include a particular feature, structure, or characteristic, but every example may or may not necessarily include that particular feature, structure, or characteristic. Moreover, such phrases are not necessarily referring to the same example. Further, when a particular feature, structure, or characteristic is described in connection with an example, it is submitted that it is within the knowledge of one skilled in the art to affect such feature, structure, or characteristic in connection with other examples whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C). Moreover, one having skill in the art will understand the degree to which terms such as "about," "approximately," or "substantially" convey in light of the measurements techniques utilized herein. To the extent such terms may not be clearly defined or understood by one having skill in the art, the term "about" shall mean plus or minus ten percent.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed:

1. A faucet comprising:

a spout body having an outlet end with an inner surface;

a flexible tube disposed within at least a portion of the spout body;

a flow conditioner positioned proximate an end of the flexible tube and at the outlet end of the spout body; and an adapter supporting the flow conditioner, the adapter having a first end and an opposite second end, the second end coupled to the end of the flexible tube such that the flow conditioner is in fluid communication with the end of the flexible tube, the first end having an outer surface supporting at least one retainer directly engaging with the inner surface of the spout body such that the flow conditioner is secured within the outlet end of the spout body, wherein the adapter has major sides and minor sides, the major sides longer than the minor sides, each of the major sides having one or more lugs that are positioned against the inner surface of the spout body, and wherein a first major side has a first lug and a second major side has a second lug, the first lug axially offset from the second lug.

2. The faucet of claim 1, wherein the at least one retainer includes an O-ring.

3. The faucet of claim 2, wherein the outer surface of the adapter includes a recessed channel supporting the O-ring.

4. The faucet of claim 1, wherein the inner surface of the spout body includes at least one projection interfacing with the at least one retainer.

5. The faucet of claim 4, wherein the at least one projection includes a ramp surface facing the outlet end and an opposite step surface.

6. The faucet of claim 1, wherein the flow conditioner is rectangular in cross-sectional shape.

7. The faucet of claim 1, wherein the adapter is rectangular in cross-sectional shape.

8. The faucet of claim 1, wherein the minor sides are at least partially rounded.

9. A faucet comprising:

a spout body having an outlet end with an inner surface, wherein the inner surface of the spout body defines a stop;

a flow conditioner positioned at the outlet end of the spout body, the flow conditioner having major sides and minor sides, the major sides longer than the minor sides;

an adapter having a first end and an opposite second end, the adapter having an opening extending therethrough, the first end shaped and sized to support the flow conditioner such that the adapter has corresponding major walls and minor walls, the first end having at least one retainer exterior of the flow conditioner, the at least one retainer slidable within the inner surface of the spout body to secure the first end of the adapter at the outlet end of the spout body, wherein the stop of the inner surface of the spout body engages with the at least one retainer; and a flexible tube coupled to the second end of the adapter, the flexible tube in fluid communication with the flow conditioner.

10. The faucet of claim 9, wherein the adapter is visible at the outlet end of the spout body.

11. The faucet of claim 9, wherein the first end of the adapter includes a flange that prevents the first end of the adapter from sliding past the stop when being inserted into the outlet end of the spout body.

12. The faucet of claim 9, wherein the at least one retainer is formed from a resilient material.

13. The faucet of claim 9, wherein the at least one retainer is located on the major walls and the minor walls of the adapter.

14. The faucet of claim 9, wherein the spout body is at least partially curved in shape, a radius of curvature of the spout body being less than three inches.

15. The faucet of claim 9, wherein a first major wall of the adapter includes at least one first lug and a second major wall of the adapter includes at least one second lug, the at least one first and second lugs engaging with the inner surface of the spout body to position the adapter therein.

16. The faucet of claim 9, wherein the first end of the adapter has a different cross-sectional shape than the second end of the adapter.

17. A faucet comprising:

a spout body having an outlet end with an inner surface, the inner surface including at least one projection proximate the outlet end;

a flexible tube disposed at least partially within the spout body, the flexible tube slidable with respect to the spout body;

an adapter coupled to an end of the flexible tube proximate the outlet end of the spout body, the adapter having an inner cavity and an outer surface, an O-ring is supported on the outer surface, and at least two lugs extend from the outer surface; and a flow conditioner supported at least partially within the inner cavity of the adapter and in fluid communication with the flexible tube, wherein the at least two lugs are disposed on opposite sides of the adapter and offset along a length of the adapter, wherein upon insertion of the adapter into the outlet end, the O-ring at least partially compresses to slide across the at least one projection such that the O-ring engages with the inner surface and secures the flow conditioner at the outlet end of the spout body, the at least two lugs are positioned against the inner surface of the spout body.

18. The faucet of claim 17, wherein the flow conditioner is spaced apart from the end of the flexible tube.

* * * * *